US010186358B2

(12) United States Patent
Kato et al.

(10) Patent No.: US 10,186,358 B2
(45) Date of Patent: Jan. 22, 2019

(54) METAL POWDER CORE, COIL COMPONENT EMPLOYING SAME, AND FABRICATION METHOD FOR METAL POWDER CORE

(71) Applicant: Hitachi Metals, Ltd., Tokyo (JP)

(72) Inventors: Tetsuro Kato, Osaka (JP); Shin Noguchi, Osaka (JP); Kazunori Nishimura, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 112 days.

(21) Appl. No.: 14/904,022

(22) PCT Filed: Jul. 17, 2014

(86) PCT No.: PCT/JP2014/068985
§ 371 (c)(1),
(2) Date: Jan. 8, 2016

(87) PCT Pub. No.: WO2015/008813
PCT Pub. Date: Jan. 22, 2015

(65) Prior Publication Data

US 2016/0155549 A1 Jun. 2, 2016

(30) Foreign Application Priority Data

Jul. 17, 2013 (JP) ..... 2013-148393

(51) Int. Cl.
*H01F 27/24* (2006.01)
*H01F 1/147* (2006.01)
(Continued)

(52) U.S. Cl.
CPC ..... *H01F 1/147* (2013.01); *B22F 1/0062* (2013.01); *B22F 3/02* (2013.01); *B22F 9/04* (2013.01);
(Continued)

(58) Field of Classification Search
CPC ..... H01F 5/00; H01F 27/00–27/36
(Continued)

(56) References Cited

U.S. PATENT DOCUMENTS 9,704,627 B2 * 7/2017 Kato ..... H01F 1/28
2007/0144615 A1 6/2007 Komuro et al.
(Continued)

FOREIGN PATENT DOCUMENTS

CN 1988065 A 6/2007
EP 2806433 A1 11/2014
(Continued)

OTHER PUBLICATIONS

Extended European Search Report for EP Application No. 14825820.5 dated Feb. 7, 2017, 7 pages.
(Continued)

*Primary Examiner* — Tuyen Nguyen
(74) *Attorney, Agent, or Firm* — Rudy J. Ng; Bret E. Field; Bozicevic, Field & Francis LLP

(57) ABSTRACT

Provided are: a metal powder core having a configuration suitable for core loss reduction and strength improvement; a coil component employing this; and a fabrication method for metal powder core. The metal powder core is obtained by dispersing Cu powder among soft magnetic material powder comprising pulverized powder of Fe-based soft magnetic alloy and atomized powder of Fe-based soft magnetic alloy and then by performing compaction. The fabrication method for metal powder core includes: a mixing step of mixing together soft magnetic material powder containing thin-leaf shaped pulverized powder of Fe-based soft magnetic alloy and atomized powder of Fe-based soft magnetic alloy, Cu powder, and a binder and thereby obtaining a mixture; a forming step of performing pressure forming on the mixture
(Continued)

obtained at the mixing step; and a heat treatment step of annealing a formed article obtained at the forming step.

6 Claims, 13 Drawing Sheets

(51) Int. Cl.

| | |
|---|---|
| ***H01F 5/00*** | (2006.01) |
| ***H01F 1/153*** | (2006.01) |
| ***H01F 1/24*** | (2006.01) |
| ***H01F 3/08*** | (2006.01) |
| ***B22F 1/00*** | (2006.01) |
| ***B22F 3/02*** | (2006.01) |
| ***B22F 9/04*** | (2006.01) |
| ***C21D 9/00*** | (2006.01) |
| ***C22C 9/02*** | (2006.01) |
| ***C22C 45/02*** | (2006.01) |
| ***H01F 1/22*** | (2006.01) |
| *H01F 1/26* | (2006.01) |

(52) U.S. Cl.
CPC ..... *C21D 9/0068* (2013.01); *C22C 9/02* (2013.01); *C22C 45/02* (2013.01); *H01F 1/15308* (2013.01); *H01F 1/22* (2013.01); *H01F 1/24* (2013.01); *H01F 3/08* (2013.01); *H01F 5/00* (2013.01); *H01F 27/24* (2013.01); *B22F 2301/10* (2013.01); *B22F 2301/35* (2013.01); *B22F 2302/45* (2013.01); *B22F 2998/10* (2013.01); *B22F 2999/00* (2013.01); *C22C 2202/02* (2013.01); *H01F 1/26* (2013.01)

(58) Field of Classification Search
USPC ..... 336/65, 83, 90, 96, 200, 232–234
See application file for complete search history.

(56) References Cited

U.S. PATENT DOCUMENTS

| | | | | |
|---|---|---|---|---|
| 2011/0080248 | A1 | 4/2011 | Nishimura | |
| 2011/0265915 | A1 | 11/2011 | Tsuchiya et al. | |
| 2011/0285486 | A1 | 11/2011 | Maeda et al. | |
| 2012/0319812 | A1* | 12/2012 | Shang ..... | H01F 27/306 336/233 |
| 2013/0181802 | A1 | 7/2013 | Watanabe et al. | |

FOREIGN PATENT DOCUMENTS

| | | | |
|---|---|---|---|
| JP | H10-208923 | A | 8/1998 |
| JP | 2005-347449 | A | 12/2005 |
| JP | 2009-280907 | A | 12/2009 |
| JP | 2010-114222 | A | 5/2010 |
| KR | 10-2011-0071021 | A | 6/2011 |
| WO | WO2009139368 | A1 | 11/2009 |
| WO | WO2012057153 | A1 | 5/2012 |

OTHER PUBLICATIONS

English translation of International Search Report for PCT/JP2014/068985 dated Oct. 14, 2014, 2 pages.

* cited by examiner

500 MAGNIFICATIONS

3000 MAGNIFICATIONS

3000 MAGNIFICATIONS

300 MAGNIFICATIONS

1000 MAGNIFICATIONS

METAL POWDER CORE, COIL COMPONENT EMPLOYING SAME, AND FABRICATION METHOD FOR METAL POWDER CORE

CROSS-REFERENCE TO RELATED APPLICATIONS

This application is the national phase under 35 U. S. C. § 371 of PCT International Application No. PCT/JP2014/068985 which has an International filing date of Jul. 17, 2014 and designated the United States of America.

FIELD

The present invention relates to: a metal powder core employed in a PFC circuit adopted in an electrical household appliance such as a television and an air-conditioner, in a power supply circuit for photovoltaic power generation or of a hybrid vehicle or an electric vehicle, or in the like; a coil component employing this; and a fabrication method for metal powder core.

BACKGROUND

A first stage of a power supply circuit of an electrical household appliance is constructed from an AC/DC converter circuit converting an AC (alternating current) voltage to a DC (direct current) voltage. In this converter circuit, a PFC circuit is provided for reducing reactive power and a harmonic noise. In order that size reduction, height reduction, or the like may be achieved in a choke employed in the circuit, the core employed in this is required to have a high saturation magnetic flux density, a low core loss, and an excellent direct-current superposing characteristic (a high incremental permeability).

Further, in an electric power unit mounted on an electric-motor driven vehicle such as a hybrid vehicle whose rapid spreading has begun in recent years, on a photovoltaic power generation apparatus, or on the like, a reactor tolerant of high currents is employed. Also in the core for such a reactor, a high saturation magnetic flux density is similarly required.

For the purpose of satisfying the above-described requirement, a metal powder core is adopted that has a satisfactory balance between the high saturation magnetic flux density and the low loss. For example, the metal powder core is obtained by employing soft magnetic powder of Fe—Si—Al-based, Fe—Si-based, or the like and then performing forming after performing insulation treatment on the surface thereof. Thus, electric resistance is improved by the insulation treatment so that eddy current loss is suppressed.

As a technique relevant to this, International Publication No. 2010/084812 proposes a metal powder core employing: first magnetic atomized powder; and second magnetic atomized powder having a smaller grain diameter than that. Composite magnetic powder in which the surface of the first magnetic atomized powder is covered by the second magnetic atomized particles by using a binder is formed and then pressure forming is performed on this so that a metal powder core is obtained in which the density is improved and the eddy current loss is suppressed. Further, paragraph [0029] in International Publication No. 2010/084812 describes that as an embodiment, powder or the like such as copper powder may further be employed. However, it does not describe what kind of operation effect is caused by the powder or the like such as copper powder. Here, for example, the first and the second magnetic atomized powder are composed of a soft magnetic material such as iron (Fe), an iron (Fe)-silicon (Si)-based alloy, an iron (Fe)-aluminum (Al)-based alloy, an iron (Fe)-nitrogen (N)-based alloy, an iron (Fe)-nickel (Ni)-based alloy, an iron (Fe)-carbon (C)-based alloy, an iron (Fe)-boron (B)-based alloy, an iron (Fe)-cobalt (Co)-based alloy, an iron (Fe)-phosphorus (P)-based alloy, an iron (Fe)-nickel (Ni)-cobalt (Co)-based alloy, and an iron (Fe)-aluminum (Al)-silicon (Si)-based alloy.

Japanese Patent Application Laid-Open No. H10-208923 proposes a metal powder core obtained such that a mixture containing: a soft magnetic material such as pure iron, an Fe—Si—Al-based material, an Fe—Si-based material, permalloy, and permendur; at least one or more kinds selected from Fe, Al, Ti, Sn, Si, Mn, Ta, Zr, Ca, and Zn serving as A-group metals; and one or more kinds selected from oxides B (oxides having a higher oxide generation energy than the A-group metals); is pressed and then heat treatment is performed at 500 degrees C. or higher. When one having a high ductility is employed as the A-group metal, at the time that it is mixed with the magnetic material and then pressed, the A-group metal suffers plastic deformation so that the compacting pressure is allowed to be reduced and hence the strain in the magnetic material is also reduced so that the hysteresis loss is reduced. The oxides B having a higher oxide generation energy than the A-group metals are oxides such as Cu, Bi, and V.

International Publication No. 2009/139368 proposes a metal powder core in which an Fe-based amorphous alloy is employed as a magnetic material for the purpose of further core loss reduction, strength improvement, and the like. Pulverized powder of Fe-based amorphous alloy ribbon and atomized powder of Fe-based amorphous alloy containing Cr are employed as main components and then the grain diameters and the mixing ratio of these are set forth so that the compaction density is improved. By virtue of this, a low core loss and an excellent direct-current superposing characteristic are obtained which are the features of Fe-based amorphous alloy ribbon.

SUMMARY

When magnetic materials having different properties are combined like in the configuration described in International Publication No. 2010/084812, Japanese Patent Application Laid-Open No. H10-208923 and International Publication No. 2009/139368, in comparison with a metal powder core constructed from single magnetic powder, a low core loss is obtained and improvement in the forming density and the strength is also expected.

However, among the crystalline magnetic materials in International Publication No. 2010/084812 and Japanese Patent Application Laid-Open No. H10-208923, the Fe—Al—Si alloy and the permalloy (an 80Ni—Fe alloy) have small magnetostriction but a low saturation magnetic flux density. Further, the other magnetic materials have a high saturation magnetic flux density but a high hysteresis loss caused by crystal magnetic anisotropy and magnetostriction resulting from the crystal structure. Thus, a high saturation magnetic flux density and a low core loss are realized simultaneously.

On the other hand, like in International Publication No. 2009/139368, when the Fe-based amorphous alloy is employed as the magnetic material, although the magnetostriction is large, the saturation magnetic flux density is high and the crystal magnetic anisotropy is small. Thus, when the stress strain is reduced by heat treatment (annealing), the hysteresis loss is improved so that the core loss is allowed to be reduced in a state that a high saturation magnetic flux density is obtained.

However, there is a strong demand for efficiency improvement and size reduction in various power supply apparatuses. Thus, also in the metal powder core employed therein, further core loss reduction and strength improvement are required.

Thus, in view of the above-described problem, an object of the present invention is to provide: a metal powder core having a configuration suitable for core loss reduction and strength improvement; a coil component employing this; and a fabrication method for metal powder core.

The metal powder core of the present invention is a metal powder core obtained by dispersing Cu powder among soft magnetic material powder containing pulverized powder of Fe-based soft magnetic alloy and atomized powder of Fe-based soft magnetic alloy and then by performing compaction.

Further, in the metal powder core of the present invention, it is preferable that when the total amount of the soft magnetic material powder and the Cu powder is referred to as 100 mass %, the content of atomized powder of Fe-based soft magnetic alloy is 1 mass % or higher and 20 mass % or lower, the content of Cu powder is 0.1 mass % or higher and 5 mass % or lower, and the remaining part is pulverized powder of Fe-based soft magnetic alloy.

Further, in the metal powder core of the present invention, it is preferable that the pulverized powder and the atomized powder have an amorphous structure.

Further, in the metal powder core of the present invention, it is preferable that the pulverized powder has an α-Fe crystalline phase in a part of the amorphous structure.

Further, in the metal powder core of the present invention, it is preferable that an insulation coating of silicon oxide is provided at least on a surface of a particle of the pulverized powder of Fe-based soft magnetic alloy.

Further, the present invention is a coil component including: any one of the metal powder cores described above; and a coil wound around the metal powder core.

Further, the present invention is a fabrication method for metal powder core including: a mixing step of mixing together soft magnetic material powder containing thin-leaf shaped pulverized powder of Fe-based soft magnetic alloy and atomized powder of Fe-based soft magnetic alloy, Cu powder, and a binder and thereby obtaining a mixture; a forming step of performing pressure forming on the mixture obtained at the mixing step; and a heat treatment step of annealing a formed article obtained at the forming step.

In the fabrication method of the present invention, it is preferable that a temperature of annealing at the heat treatment step is a temperature of causing an α-Fe crystalline phase to occur in a part of an amorphous matrix of the pulverized powder.

It is preferable that the mixing step includes: a first mixing step of mixing together soft magnetic material powder, Cu powder, and silicone-based insulating resin; and a second mixing step of adding water-soluble acrylic-based resin or polyvinyl alcohol diluted with water into a first mixture obtained at the first mixing step, and then performing mixing.

Further, it is preferable to include a drying step of drying a second mixture obtained at the second mixing step.

In the fabrication method of the present invention, it is preferable that the pulverized powder of Fe-based soft magnetic alloy is obtained by performing an embrittlement step of warming and embrittling Fe-based amorphous alloy and then by performing pulverization.

In the fabrication method of the present invention, it is preferable to include an insulation coating formation step of providing an insulation coating of silicon oxide in the pulverized powder posterior to a pulverization step.

According to the present invention, allowed to be provided are: a metal powder core having a reduced core loss as well as a high strength; and a coil component employing this.

The above and further objects and features will more fully be apparent from the following detailed description with accompanying drawings.

DETAILED DESCRIPTION

Figure 1:
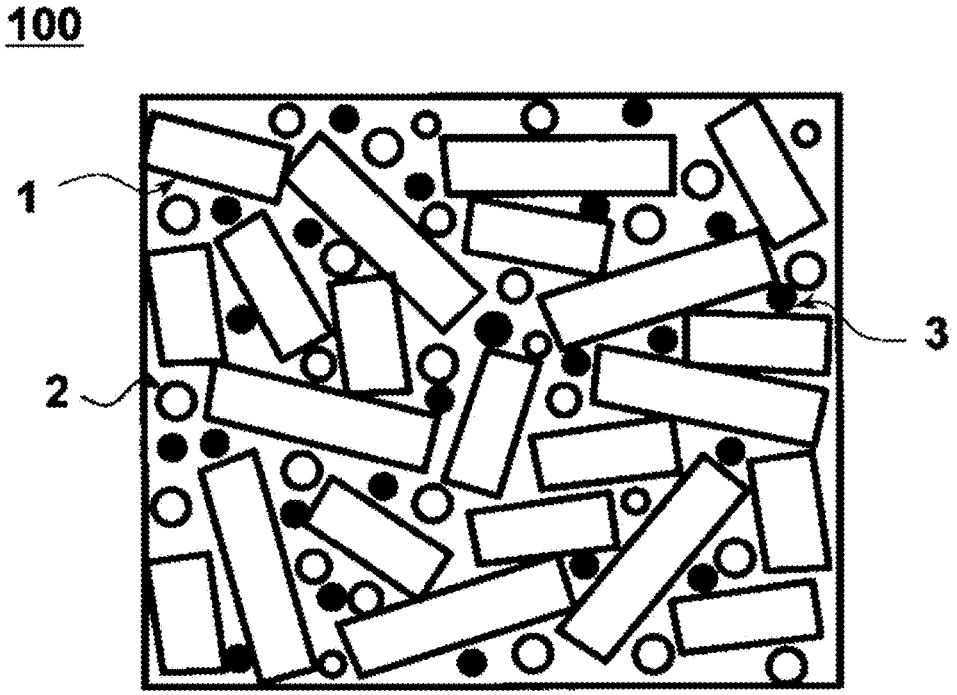
FIG. 1 is a schematic diagram of a metal powder core cross section, illustrating the concept of a metal powder core according to the present invention.

Embodiments of a metal powder core and a coil component according to the present invention are described below in detail. However, the present invention is not limited to these embodiments. FIG. 1 is a schematic diagram illustrating the cross section of a metal powder core according to the present invention. A metal powder core 100 is constructed such that mixed powder containing soft magnetic material powder (pulverized powder 1 of Fe-based soft magnetic alloy and atomized powder 2 of Fe-based soft magnetic alloy), Cu powder 3 serving as nonmagnetic material powder, and insulating resin is compaction-formed and then given heat treatment is performed so that the soft magnetic material powder and the Cu powder are bound together with a binding material (a binder) such as silicone resin and low-temperature glass. The binding material intervenes between the soft magnetic material powder and the Cu powder so as to link them together and, at the same time, serves also as an insulator. In FIG. 1, the up and down direction corresponds to the compression direction at the time of forming.

Figure 2:
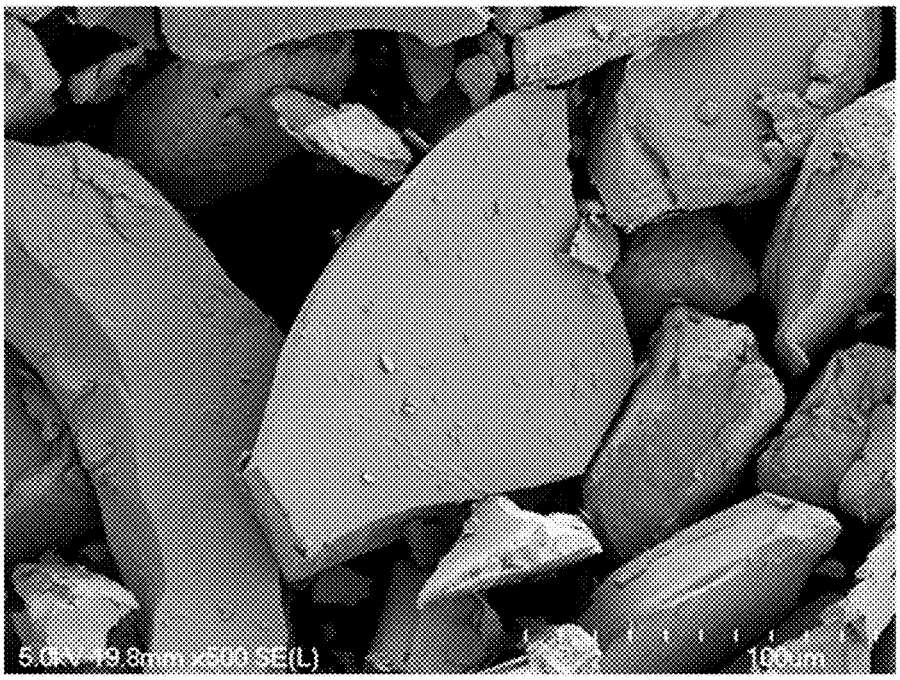
FIG. 2 is an SEM photograph presenting an external appearance of pulverized powder of Fe-based amorphous alloy employed in a metal powder core according to the present invention.

The soft magnetic material powder contains the pulverized powder 1 of Fe-based soft magnetic alloy and the atomized powder 2 of Fe-based soft magnetic alloy. FIG. 2 illustrates an SEM photograph presenting an external appearance of the pulverized powder 1 of Fe-based soft magnetic alloy. The pulverized powder 1 is obtained by pulverizing an Fe-based amorphous alloy formed thinly in the shape of a foil or a ribbon. Then, the pulverized powder 1 is in a thin-leaf shape having two planes oppose to each other and side surfaces connecting the two planes. Further, in the pulverized powder 1, because of the shape of the particle, in accordance with a stress acting at the time of forming from the up and down directions in the figure, the two planes are easily orientated in a direction perpendicular to the direction of acting of the stress. Thus, in FIG. 1, the cross section is illustrated in a rectangular shape as a situation that side surfaces appear in an oriented manner.

Figure 3:
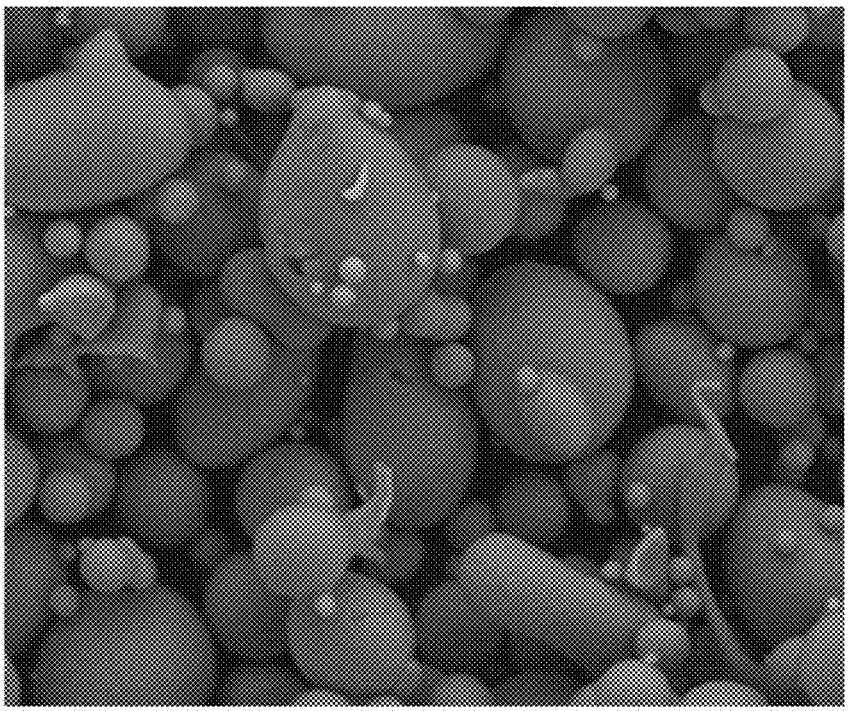
FIG. 3 is an SEM photograph presenting an external appearance of atomized powder of Fe-based amorphous alloy employed in a metal powder core according to the present invention.

FIG. 3 illustrates an SEM photograph presenting an external appearance of the atomized powder 2 of Fe-based soft magnetic alloy. The Fe-based soft magnetic alloy illustrated here is an Fe-based amorphous alloy. Then, the atomized powder 2 is particles each having a shape closer to a spherical shape than that of the pulverized powder 1. Thus, in FIG. 1, the cross section is illustrated in the shape of a sphere.

Figure 4:
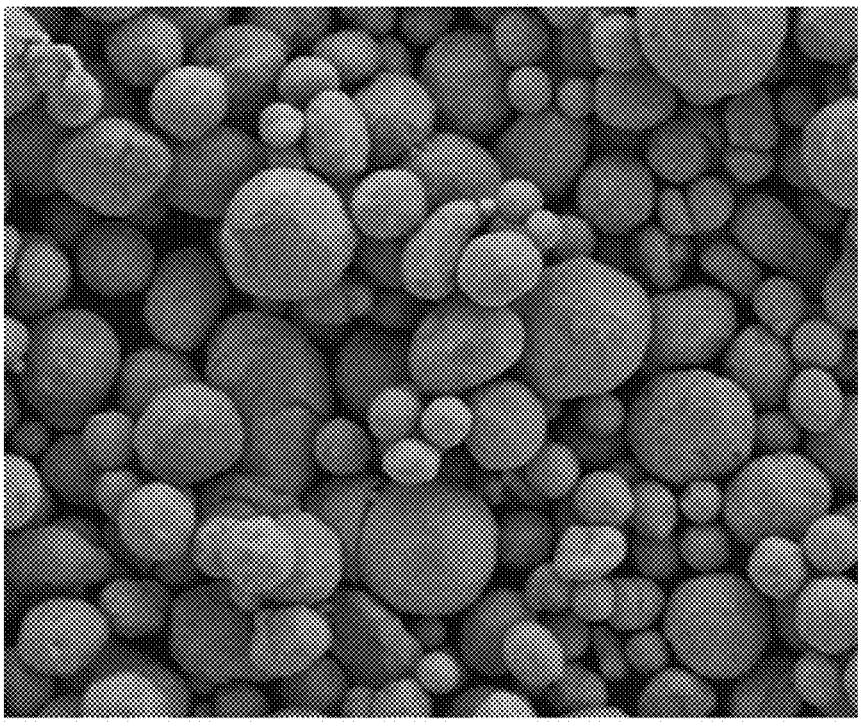
FIG. 4 is an SEM photograph presenting an external appearance of Cu powder employed in a metal powder core according to the present invention.

Further, the Cu powder 3 is dispersed among the soft magnetic material powder. The term "dispersion" mentioned here includes a situation that the grains constituting the Cu powder 3 are present separately from each other as well as a situation that a plurality of the grains aggregate together so as to form aggregates and then these or the like are present separately from each other among the soft magnetic material powder. Such configurations are allowed to be obtained by compaction of the mixed powder of the Cu powder 3 and the soft magnetic material powder. FIG. 4 illustrates an SEM photograph presenting an external appearance of the Cu powder. The Cu powder is obtained by an atomizing method, an oxide reduction method serving as a chemical process, or the like. In FIG. 1, the particle cross section is illustrated in the shape of a sphere.

The mixed Cu powder intervenes among the soft magnetic material powder. Then, by virtue of this configuration, core loss reduction and strength improvement of the metal powder core are realized. This point is described below in detail.

First, the soft magnetic material powder employed in the metal powder core according to the present invention is described below. The soft magnetic material powder contains the pulverized powder 1 of Fe-based soft magnetic alloy and the atomized powder 2 of Fe-based soft magnetic alloy. The Fe-based soft magnetic alloy constituting the pulverized powder and the atomized powder is allowed to be selected suitably in accordance with required mechanical and magnetic characteristics regardless of difference in the composition. When the Fe-based amorphous alloy is employed as the soft magnetic material powder, a metal powder core having a low magnetic loss is easily obtained in comparison with a case that crystalline soft magnetic material powder is employed.

The pulverized powder 1 of Fe-based soft magnetic alloy is fabricated from a ribbon or a foil of an amorphous alloy or a nanocrystalline alloy. For example, the alloy ribbon is a ribbon obtained such that a raw material weighed such that a given composition may be obtained is melted by means of high-frequency induction melting or the like and, after that, a publicly known quenching method employing a single roll is performed on the molten alloy. Then, an amorphous alloy ribbon or a nanocrystalline alloy ribbon whose plate thickness is ten plus several μm to 30 μm or the like is preferable.

Further, the atomized powder of Fe-based soft magnetic alloy is powder obtained by quenching molten alloy by an atomizing method. The Fe-based soft magnetic alloy may be selected suitably in accordance with a required magnetic property.

The pulverized powder of Fe-based soft magnetic alloy has a plate shape. Thus, when pulverized powder alone is employed, the powder has unsatisfactory fluidity and hence gaps easily occur. This causes difficulty in density enhancement of the metal powder core. On the other hand, the atomized powder is granular and hence fills gaps among the pulverized powder so as to contribute to improvement in the space factor of the soft magnetic material powder and improvement in the magnetic property. For the purpose of density and strength improvement, it is preferable that the grain diameter of the atomized powder is 50% or smaller of the thickness of the pulverized powder. On the other hand, when the grain diameter of the atomized powder is reduced, aggregation easily occurs and hence dispersion becomes difficult. Thus, the grain diameter of the atomized powder is preferably 3 μm or larger. The grain diameter of the atomized powder is measured by a laser diffraction scattering method. Then, the average grain diameter is allowed to be evaluated as a median diameter D50 (corresponding to an accumulated 50 volume % which is the particle diameter obtained at the time that the particles are counted in an ascending order of particle diameters until 50 volume % of the entirety is reached by conversion).

When the atomized powder is present, a tendency arises that the strength and the magnetic property are improved in comparison with a case of pulverized powder alone. Thus, in the present invention, as long as the atomized powder is present, the ratio between the pulverized powder and the atomized powder is not limited to this particular value. However, even when the ratio of the atomized powder is increased more than required, the strength improvement is saturated. The amount of insulating resin required for linking together the powder increases and hence improvement in the magnetic property is saturated. Then, when the ratio is increased further, this causes an increase in the magnetic loss and a decrease in the initial permeability. The atomized powder causes a higher cost than the pulverized powder. Thus, it is more preferable that when the total amount of the soft magnetic material powder and the Cu powder is referred to as 100 mass %, the content of the atomized powder is 1 to 20 mass %.

There is a limit on aiming improvement in the strength or the magnetic property by means of merely mixing the atomized powder into the pulverized powder as described above. In contrast, the present inventors have found that the presence of Cu powder, which is intrinsically disadvantageous for ensuring insulation among the soft magnetic powder, reduces the core loss further and, in addition, increases the strength.

The reason of the effect obtained by dispersing the Cu powder among the soft magnetic powder is not clear. However, the following inference is proposed.

The Cu powder is softer than the soft magnetic material powder and hence plastically deformed easily at the time of compaction. This contributes to density and strength improvement. Further, this plastic deformation relaxes also a stress in the soft magnetic material powder. Although details are described later, the configuration that the Cu powder is dispersed among the soft magnetic material powder is allowed to be realized by a method that the Cu powder is added before compaction of the soft magnetic material powder so that aggregated particles are formed in which the atomized powder and the Cu powder of Fe-based soft magnetic alloy are bound to the surface of a particle of the pulverized powder of Fe-based soft magnetic alloy by using an organic binder. When the forms of aggregated particles are employed, the soft magnetic material powder and the Cu powder are not separated from each other before compaction. Further, improvement in the fluidity of the powder at the time of pressure forming is also expected.

Further, in the present invention, as the soft magnetic material powder, soft magnetic material powder other than the pulverized powder and the atomized powder of Fe-based soft magnetic alloy may also be contained. However, the configuration that the soft magnetic material powder is composed of the pulverized powder and the atomized powder alone is advantageous for core loss reduction and the like. Further, in the present invention, non-magnetic metal powder other than Cu powder may be contained. However, in order that the effect of Cu powder may be expressed to the maximum extent, it is more preferable that the non-magnetic metal powder consists of Cu powder alone. Further, in some cases, an inorganic insulator having a thickness of submicron order is formed on the surface of a particle of the pulverized powder of Fe-based soft magnetic alloy.

Here, important features of the present invention are described further. Dispersion of Cu powder achieved by addition of Cu powder expresses a remarkable effect not only in density and strength improvement but also in loss reduction. When Cu powder is dispersed among thin-leaf shaped pulverized powder, the core loss is reduced in comparison with a case that Cu powder is not contained, that is, Cu powder is not dispersed. It has been recognized that even a very small amount of Cu powder expresses an effect of remarkable reduction of the core loss. Thus, the amount of usage is allowed to be suppressed small. On the contrary, when the amount of usage is increased, an effect of remarkable reduction of the core loss is obtained. Thus, the configuration that Cu powder is contained and the Cu powder is dispersed among the soft magnetic material powder is allowed to be recognized as a configuration preferable for core loss reduction.

In the present invention, in the expression that Cu powder is dispersed among soft magnetic material powder, Cu powder is not indispensably required to intervene everywhere in the soft magnetic material powder. That is, it is sufficient that Cu powder intervenes among at least a part of the soft magnetic material powder, that is, between the pulverized powder and the pulverized powder, between the pulverized powder and the atomized powder, and between the atomized powder and the atomized powder. FIG. 1 illustrates, as a model, a situation that the particles are present independently. However, in some cases, these particles are present in an aggregated manner.

Further, the Cu powder is composed of metallic copper (Cu) or a Cu alloy and may contain unavoidable impurities. Further, for example, the Cu alloy is Cu—Sn, Cu—P, Cu—Zn, or the like and is powder whose main component is Cu (50 atom % or higher of Cu is contained). Among Cu and Cu alloys, at least one kind may be employed. However, among these, Cu which is soft is more preferable.

When a larger amount of Cu powder is dispersed, the strength or the like is improved more. From this perspective, the content of Cu is not set forth. However, the Cu powder itself is a non-magnetic material. Thus, when the function as a metal powder core is taken into consideration, for example, 20 mass % or lower is a practical range for the content of Cu powder relative to 100 mass % of the soft magnetic material powder. Even a very small amount of Cu powder expresses an effect of sufficient loss reduction. However, on the other hand, an excessive content of Cu powder causes a tendency of magnetic permeability reduction.

Further, from the perspective of utilizing a sufficient effect obtained by containing of Cu powder, it is more preferable that when the total amount of the soft magnetic material powder and the Cu powder is referred to as 100 mass %, the content of Cu powder is 0.1 mass % or higher. On the other hand, from the perspective of maintaining the magnetic property such as the incremental permeability, it is more preferable that the content of Cu powder is 5 mass % or lower. Further, preferably, the content of Cu powder is 0.3 to 3 mass %. Further, more preferably, the content is 0.3 to 1.4 mass %.

The morphology of dispersed Cu powder is not limited to particular one. Further, the morphology of Cu powder to be mixed is also not limited to particular one. However, from the perspective of fluidity improvement at the time of pressurized formation, it is more preferable that the Cu powder is granular, especially, spherical. Such Cu powder is obtained, for example, by an atomizing method. However, the method is not limited to this.

It is sufficient that the grain diameter of the Cu powder is at a level at least permitting dispersion among the thin-plate shaped pulverized powder. Granular powder like the Cu powder which is softer than the soft magnetic material powder improves the fluidity of the soft magnetic material powder and, at the same time, plastically deforms at the time of compaction so as to reduce gaps among the soft magnetic material powder. For example, in order that the gaps among the pulverized powder may be reduced more reliably, it is preferable that the grain diameter of the Cu powder is smaller than or equal to the thickness of the pulverized powder. Further, it is more preferable that the grain diameter is 50% or smaller of the thickness of the pulverized powder.

The thin-leaf shaped pulverized powder is obtained by pulverizing a ribbon-shaped soft magnetic alloy. Then, as the thickness of the ribbon of the soft magnetic alloy or the like prior to pulverization, with taking into consideration the thickness of an ordinary amorphous alloy ribbon or nanocrystalline alloy ribbon, Cu powder of 8 μm or smaller has high universality and hence is more preferable. When the grain diameter becomes excessively small, the cohesive force of the powder becomes large and hence dispersion becomes difficult. Thus, it is more preferable that the grain diameter of the Cu powder is 2 μm or larger. The grain diameter of the Cu powder employed as a raw material may be evaluated as the median diameter D50 (a particle diameter corresponding to the accumulated 50 volume %; referred to as an average grain diameter, hereinafter).

For example, as the soft magnetic alloy ribbon, a quenched ribbon obtained by quenching molten alloy like in a single-roll technique is employed. The alloy composition is not limited to particular one and may be selected in accordance with the required characteristics. In the case of an amorphous alloy ribbon, it is preferable to employ an Fe-based amorphous alloy ribbon having a high saturation magnetic flux density Bs of 1.4 T or higher. For example, an Fe-based amorphous alloy ribbon of Fe—Si—B-based or the like represented by Metglas (registered trademark) 2605SA1 material may be employed. Further, an Fe—Si—B—C-based composition, an Fe—Si—B—C—Cr-based composition, or the like containing other elements may also be employed. Further, a part of Fe may be replaced by Co or Ni.

On the other hand, in the case of a nanocrystalline alloy ribbon, it is preferable to employ an Fe-based nanocrystalline alloy ribbon having a high saturation magnetic flux density Bs of 1.2 T or higher. The employed nanocrystalline alloy ribbon may be a soft magnetic alloy ribbon known in the conventional art and having a microcrystalline structure whose grain diameter is 100 nm or smaller. Specifically, for example, an Fe-based nanocrystalline alloy ribbon of Fe—Si—B—Cu—Nb-based, Fe—Cu—Si—B-based, Fe—Cu—B-based, Fe—Ni—Cu—Si—B-based, or the like may be employed. Further, a substance in which a part of these elements are replaced or a substance in which other elements are added may be employed.

As such, when an Fe-based nanocrystalline alloy is employed as the magnetic material, it is sufficient that the pulverized powder in the finally obtained metal powder core has a nanocrystalline structure. Thus, at the time of pulverization or mixing, the soft magnetic alloy ribbon may be an Fe-based nanocrystalline alloy ribbon or alternatively an Fe-based alloy ribbon showing an Fe-based nanocrystalline structure. The alloy ribbon showing an Fe-based nanocrystalline structure indicates an alloy ribbon whose pulverized powder has an Fe-based nanocrystalline structure in the finally obtained metal powder core having undergone crystallization treatment regardless of being in an amorphous alloy state at the time of pulverization. For example, this corresponds to a case that crystallization heat treatment is performed on the pulverized powder after pulverization, a case that crystallization heat treatment is performed on a formed article after forming, or another case.

It is preferable that the thickness of the soft magnetic alloy ribbon falls among a range from 10 to 50 μm. When the thickness is smaller than 10 μm, the mechanical strength of the alloy ribbon itself is low and hence stably casting of a long alloy ribbon becomes difficult. Further, when the thickness exceeds 50 μm, a part of the alloys is easily crystallized and hence, in some cases, the characteristics are degraded. It is more preferable that the thickness of the soft magnetic alloy ribbon is 13 to 30 μm.

Further, when the grain diameter of the pulverized powder of soft magnetic alloy ribbon is made smaller, the processing strain introduced by the pulverization becomes larger. This causes an increase in the core loss. On the other hand, when the grain diameter is large, the fluidity decreases so that density enhancement becomes difficult to be achieved. Thus, it is preferable that the grain diameter of the pulverized powder of soft magnetic alloy ribbon in a direction (the in-plane directions of the principal surfaces) perpendicular to the thickness direction is larger than 2 times of the thickness and smaller than or equal to 6 times.

In the metal powder core, when means for insulation among the soft magnetic material powder is adopted, the eddy current loss is suppressed so that a low magnetic loss is allowed to be realized. Thus, it is preferable to provide a thin insulation coating on the surface of a particle of the pulverized powder. The pulverized powder itself may be oxidized so that an oxide film may be formed on the surface. In order that an oxide film having uniformity and high reliability may be formed in a state that damage to the pulverized powder is suppressed, it is more preferable to provide an oxide film other than an oxide of the alloy component of the soft magnetic material powder.

Next, a fabrication process for a metal powder core in which Cu powder is dispersed is described below. The fabrication method of the present invention is a fabrication method for a metal powder core constructed from soft magnetic material powder in which pulverized powder of Fe-based soft magnetic alloy and atomized powder of Fe-based soft magnetic alloy are contained as soft magnetic material powder and which includes: a first process of mixing together the soft magnetic material powder and the Cu powder; and a second process of performing pressure forming of the mixed powder obtained in the first process. As a result of the first process and the second process, a metal powder core in which Cu powder is dispersed among the soft magnetic material powder is obtained. As described above, it is preferable that the content of Cu powder is 0.1 to 5 mass % relative to the total amount of 100 mass % of the soft magnetic material powder and the Cu powder. As for the part other than the first and the second process, a configuration according to a fabrication method for metal powder core known in the conventional art may suitably be applied when required.

First, a fabrication method for the pulverized powder of Fe-based soft magnetic alloy employed in the first process is described below with reference to an example that a soft magnetic alloy ribbon is employed. In pulverization of a soft magnetic alloy ribbon, the pulverizability is improved when embrittlement treatment is performed in advance. For example, an Fe-based amorphous alloy ribbon has a property that embrittlement is caused by heat treatment at 300 degrees C. or higher so that pulverization becomes easy. When the temperature of this heat treatment is increased, embrittlement occurs more strongly so that pulverization becomes easy. However, when the temperature exceeds 380 degrees C., crystallization begins. Here, remarkable crystallization of a pulverized powder affects an increase in the core loss Pcv of the metal powder core. Thus, a preferable embrittlement heat treatment temperature is 320 degrees C. or higher and 380 degrees C. or lower. The embrittlement treatment may be performed in a spooled state that the ribbon is wound in. Alternatively, the embrittlement treatment may be performed in a shaped lump state achieved when a ribbon or foil not wound in is pressed into a given shape. However, this embrittlement processing is not indispensable. For example, in the case of a nanocrystalline alloy ribbon or an alloy ribbon showing a nanocrystalline structure which are intrinsically brittle, the embrittlement treatment may be not included.

Here, the pulverized powder is allowed to be obtained by one step of pulverization. However, in order to obtain a desired grain diameter, from the perspective of pulverization ability and of uniformity in the grain diameter, it is preferable that the pulverization process is divided into at least two steps and performed in the form of coarse pulverization and fine pulverization posterior to this so that the grain diameter is reduced stepwise. It is more preferable that the pulverization is performed in three steps consisting of coarse pulverization, medium pulverization, and fine pulverization. In a case that the ribbon is in a spooled state or in a shaped lump state, it is preferable that the ribbon is cracked before the coarse pulverization. In each process from cracking to pulverization, a different mechanical apparatus is employed. That is, it is preferable that cracking into the size of a first is performed by using a compression reducing machine, coarse pulverization into thin leaves of 2 to 3 cm square is performed by using a universal mixer, middle pulverization into thin leaves of 2 to 3 mm square is performed by using a power mill, and fine pulverization into thin leaves of 100 μm square is performed by using an impact mill.

For the purpose of homogenizing the grain diameter, it is preferable that classification is performed on the pulverized powder having undergone the last pulverization process. The method of classification is not limited to particular one. However, a method employing a sieve is simple and preferable.

The atomized powder of Fe-based soft magnetic alloy is obtained by an atomizing method such as gas atomization and water atomization. As for the composition of the atomized powder, similarly to the above-described pulverized powder of Fe-based soft magnetic alloy, a composition of diverse kind may be employed. The composition of the pulverized powder and the composition of the atomized powder may be the same as each other and may be different from each other.

For the purpose of reducing the loss, it is preferable that an insulation coating is provided at least on surface of the pulverized powder among the pulverized powder and the atomized powder of Fe-based soft magnetic alloy. A formation method for this is described below with reference to the example of pulverized powder of Fe-based soft magnetic alloy ribbon. When heat treatment is performed on the pulverized powder in a humid atmosphere at 100 degrees C. or higher, Fe in the pulverized powder is oxidized or hydroxylated so that an insulation coating of iron oxide or iron hydroxide is allowed to be formed.

As for the insulation coating, a configuration that a silicon oxide film is provided on the surface of the soft magnetic material powder is more preferable. The silicon oxide is excellent in insulation. Further, a homogeneous film is easily formed by a method described later. For the purpose of reliable insulation, it is preferable that the thickness of the silicon oxide film is 50 nm or greater. On the other hand, when the silicon oxide film becomes excessively thick, the distance between the soft magnetic material powder particles becomes large and hence the magnetic permeability is reduced. Thus, it is preferable that the coating is of 500 nm or smaller.

The pulverized powder is immersed and agitated in a mixed solution of TEOS (tetraethoxysilane), ethanol, and aqueous ammonia, and then dried so that the above-described silicon oxide film is allowed to be formed on the surface of a particle of the pulverized powder. According to this method, a silicon oxide layer in a planar and network shape is formed on the surface of a particle of the pulverized powder. Thus, an insulation coating having a uniform thickness is allowed to be formed on the surface of a particle of the pulverized powder.

Next, the first process of mixing together the soft magnetic material powder containing the pulverized powder and the atomized powder and the Cu powder is described below. The mixing method for the soft magnetic material powder and the Cu powder is not limited to particular one. Then, for example, a dry type agitation mixer may be employed. Further, in the first process, the following organic binder or the like is mixed. The soft magnetic material powder, the Cu powder, the organic binder, the high-temperature binder, and the like are allowed to be mixed simultaneously. However, from the perspective of mixing uniformly and efficiently the soft magnetic material powder and the Cu powder, it is more preferable that in the first process, the soft magnetic material powder, the Cu powder, and the high-temperature binder are first mixed together and, after that, the organic binder is added and then mixing is performed further. By virtue of this, uniform mixing is allowed to be achieved in a shorter time and hence shortening of the mixing time is allowed to be achieved.

The mixture after the mixing is in a state that the atomized powder of Fe-based soft magnetic alloy, the Cu powder, and the high-temperature binder are bound to the surface of a particle of the pulverized powder of Fe-based soft magnetic alloy by virtue of the organic binder. In the state that the organic binder is mixed, the mixed powder is in a state of agglomerate powder having a wide grain size distribution by virtue of the binding function of the organic binder. When the agglomerate powder is passed and cracked through a sieve by using a vibration sieve or the like, adjusted granulated powder (aggregated particles) is obtained.

At the time of pressure forming of the mixed powder of the soft magnetic material powder and the Cu powder, the organic binder may be employed for the purpose of binding together the powder at a room temperature. On the other hand, application of post-forming heat treatment (annealing) described later is effective for the purpose of removing the processing strain by pulverization or forming. When this heat treatment is applied, the organic binder almost disappears by thermal decomposition. Thus, in the case of the organic binder alone, the binding force in the individual powder particles of the soft magnetic material powder and the Cu powder is lost after the heat treatment so that the metal powder core strength is no longer allowed to be maintained in some cases. Thus, in order that the powder may be bound together even after the heat treatment, it is effective to add a high-temperature binder together with the organic binder. It is preferable that the high-temperature binder represented by an inorganic binder is a binder that, in a temperature range where the organic binder suffers thermal decomposition, begins to express fluidity and thereby wets and spreads over the powder surface so as to bind together the powder p articles. When the high-temperature binder is applied, the adhesion face is allowed to be maintained even after being cooled to a room temperature.

It is preferable that the organic binder is a binder that maintains the binding force in the powder such that a chip or a crack may not occur in the compact in the handling prior to the pressing process and the heat treatment, and that easily suffers thermal decomposition by the heat treatment posterior to the pressing. An acryl-based resin or a polyvinyl alcohol is preferable as a binder whose thermal decomposition is almost completed by the post-forming heat treatment.

As the high-temperature binder, a low melting point glass in which fluidity is obtained at relatively low temperatures and a silicone resin which is excellent in heat resistance and insulation are preferable. As the silicone resin, a methyl silicone resin and a phenylmethyl silicone resin are more preferable. The amount to be added may be determined in accordance with: the fluidity of the high-temperature binder and the wettability and the adhesive strength relative to the powder surface; the surface area of the metal powder and the mechanical strength required in the metal powder core after the heat treatment; and the required core loss. When the added amount of the high-temperature binder is increased, the mechanical strength of the metal powder core increases. However, at the same time, the stress to the soft magnetic material powder also increases. Thus, a tendency arises that the core loss also increases. Accordingly, a low core loss and a high mechanical strength are in the relationship of trade-off. The amount to be added is set forth appropriately in accordance with the required core loss and mechanical strength.

Further, for the purpose of reducing the friction between the powder and the metal mold at the time of pressing, it is preferable that stearic acid or stearate such as zinc stearate is added to the aggregated particles by 0.3 to 2.0 mass % relative to the total mass of the soft magnetic material powder, the Cu powder, the organic binder, and the high-temperature binder and then mixing is performed.

The mixed powder obtained in the first process is granulated as described above and then provided to the second process of performing pressure forming. The granulated mixed powder is formed into a given shape such as a toroidal shape and a rectangular parallelepiped shape by pressure forming by using a forming mold. Typically, the forming is allowed to be achieved at a pressure higher than or equal to 1 GPa and lower than or equal to 3 GPa with a holding time of several seconds or the like. The pressure and the holding time are optimized in accordance with the content of the organic binder and the required compact strength. In the metal powder core, from the perspective of the strength and the characteristics, compaction to $5.3\times10^3$ kg/m$^3$ or higher is preferable in practice.

In order to obtain the magnetic property, it is preferable that the stress strain caused by the above-described pulverization process and the second process of forming is relaxed. In the case of pulverized powder obtained by pulverizing an Fe-based amorphous alloy ribbon and having an amorphous structure, when the heat treatment temperature is low, the stress remaining at the time of pulverization and forming is not sufficiently relaxed and hence the core loss is reduced not sufficiently in some cases. In order to obtain the effect of relaxation of the stress strain, it is preferable that heat treatment is performed at 350 degrees C. or higher. With increasing heat treatment temperature, the strength of the metal powder core increases also. On the other hand, when the heat treatment temperature increases, in pulverized powder not having a composition causing expression of a nanocrystalline structure, coarse crystal grains (an α-Fe crystalline phase) are deposited from the amorphous matrix so that a hysteresis loss occurs and hence the magnetic loss begins to increase. However, when the α-Fe crystalline phase deposited in the amorphous matrix is in a small amount, there is such a heat treatment temperature region that the effect of residual stress reduction exceeds the increase in the core loss caused by the crystallization. Thus, it is sufficient that the upper and lower limits of the heat treatment temperature are set to be a temperature range in which preferable magnetic properties including the magnetic loss as well as the strength are suitably obtained. Preferably, the upper limit of the heat treatment temperature is the crystallization temperature Tx-50 degrees C. or lower.

Here, the crystallization temperature Tx varies depending on the composition of the amorphous alloy. Further, a stress strain is strongly acting on the pulverized powder and hence, in some cases, the strain energy reduces the crystallization temperature Tx by several tens degrees C. in comparison with the soft magnetic alloy ribbon prior to pulverization. Here, it is premised that the crystallization temperature Tx indicates an exothermic onset temperature obtained such that the pulverized powder is temperature-raised at a temperature rise rate of 10 degrees C./min in differential scanning calorimetry in accordance with the method of determining the crystallization temperatures of amorphous metals set forth in JIS H 7151. Here, deposition of the crystalline phase in the amorphous matrix gradually begins at a temperature lower than the crystallization temperature Tx and rapidly progresses above the crystallization temperature Tx.

The holding time for the peak temperature at the time of heat treatment is set up suitably in accordance with the size of the metal powder core, the throughput, the allowable range for characteristics variations, and the like. However, 0.5 to 3 hours is preferable. The above-described heat treatment temperature is far lower than the melting point of the Cu powder. Thus, the Cu powder is maintained in a dispersed state even after the heat treatment.

On the other hand, in a case that the soft magnetic alloy ribbon is a nanocrystalline alloy ribbon or an alloy ribbon showing an Fe-based nanocrystalline structure, crystallization treatment is performed at any stage of the process so that a nanocrystalline structure is imparted to the pulverized powder. That is, the crystallization treatment may be performed before pulverization and the crystallization treatment may be performed after pulverization. Here, the scope of the crystallization treatment includes also heat treatment for crystallization acceleration of improving the ratio of the nanocrystalline structure. The crystallization treatment may serve also as heat treatment for strain relaxation posterior to the pressing, or alternatively may be performed as a process separate from the heat treatment for strain relaxation. However, from the perspective of simplification of the fabrication process, it is preferable that the crystallization treatment serves also as heat treatment for strain relaxation posterior to the pressing. For example, in the case of an alloy ribbon showing an Fe-based nanocrystalline structure, it is sufficient that the heat treatment posterior to the pressing which serves also as crystallization treatment is performed within a range from 390.C. to 480.C. Also in a case that a nanocrystalline structure is to be expressed in the atomized powder, it is sufficient that a process similar to the above-described one is applied.

The coil component of the present invention includes: a metal powder core obtained as described above; and a coil wound around the metal powder core. The coil may be constructed by winding a lead wire around the metal powder core or alternatively by winding a lead wire around a bobbin. For example, the coil component is a choke, an inductor, a reactor, a transformer, or the like. For example, the coil component is employed in a PFC circuit adopted in an electrical household appliance such as a television and an air-conditioner, in a power supply circuit for photovoltaic power generation or of a hybrid vehicle or an electric vehicle, or in the like, so as to contribute to loss reduction and efficiency improvement in these devices and apparatuses.

EMBODIMENTS

Embodiment 1 and Comparison Example 1

(Fabrication of Pulverized Powder of Fe-Based Soft Magnetic Alloy)

Figure 5:
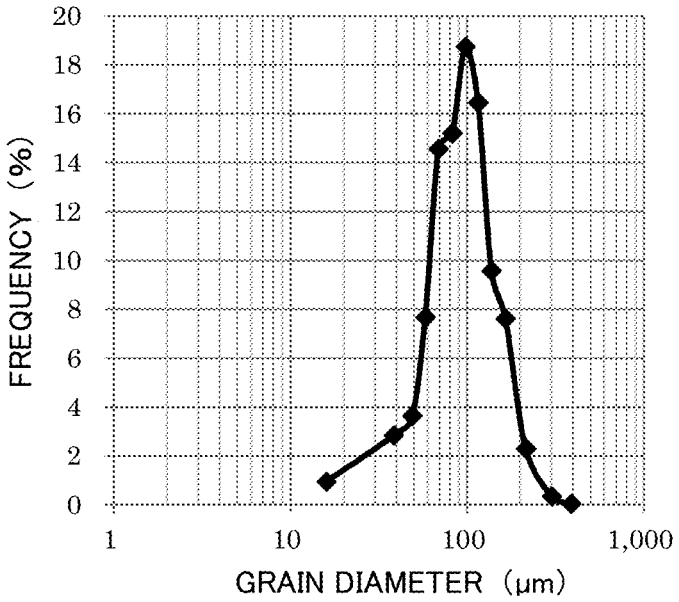
FIG. 5 is a grain size distribution diagram of pulverized powder of Fe-based amorphous alloy employed in a metal powder core according to the present invention.
Figure 6:
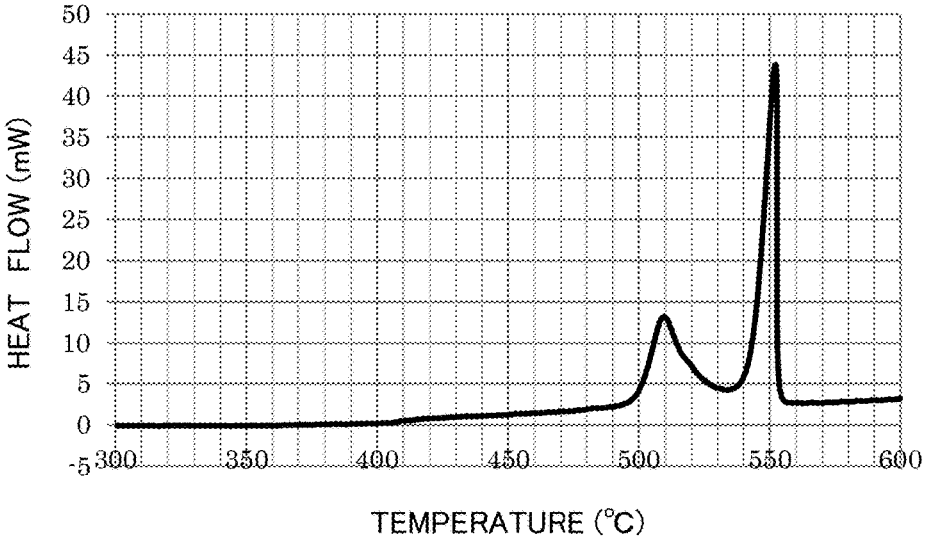
FIG. 6 is a differential thermal analysis diagram of pulverized powder of Fe-based amorphous alloy employed in a metal powder core according to the present invention.

Metglas (registered trademark) 2605SA1 material having an average thickness of 25 μm and a width of 200 mm and fabricated by Hitachi Metals, Ltd. was employed. The 2605SA1 material is an Fe-based amorphous alloy ribbon of Fe—Si—B-based material. This Fe-based amorphous alloy ribbon was wound into a wound article in a spool state having a winding diameter of ϕ200 mm. This article was heated at 360 degrees C. for 2 hours in an oven in a dried air atmosphere so that embrittlement was performed. After the wound article taken out of the oven was cooled down, coarse pulverization, medium pulverization, and fine pulverization were performed successively by different pulverizers. The obtained pulverized powder of Fe-based amorphous alloy ribbon (simply referred to as pulverized powder, hereinafter) is passed through a sieve having an aperture of 106 μm (150 μm in diagonal) and then large pulverized powder having remained in the sieve was removed. The obtained pulverized powder was classified by a plurality of sieves having different apertures so that the grain size distribution was evaluated. FIG. 5 is a grain size distribution diagram for the pulverized powder. The average grain diameter (D50) calculated from the obtained grain size distribution was 98 μm. Further, FIG. 6 illustrates the result of differential thermal analysis obtained by differential scanning calorimetry. Heat generation begun to be observed from 410 degrees C. and two peaks of heat generation were recognized at 510 degrees C. and 550 degrees C. From the obtained result, the crystallization temperature Tx was 495 degrees C. Further, in a case that heat treatment of the pulverized powder of Fe-based amorphous alloy was performed at 350 degrees C. to 500 degrees C., in the diffraction pattern of X-ray diffraction at a heat treatment temperature of 410 degrees C. or higher, an amorphous structure was major component but an alloy α-Fe crystal was recognized.

(Silicon Oxide Film Formation on Pulverized Powder Surface)

5 kg of pulverized powder, 200 g of TEOS (tetraethoxysilane, $Si(OC_2H_5)_4$), 200 g of aqueous ammonia solution (an ammonia content of 28 to 30 volume %), and 800 g of ethanol were mixed together and then agitated for 3 hours. Then, the pulverized powder was separated and then dried in an oven at 100 degrees C. After the drying, the cross section of the pulverized powder was observed by an SEM. Then, a silicon oxide film was formed on the surface and its thickness was 80 to 150 nm.

Figure 7:
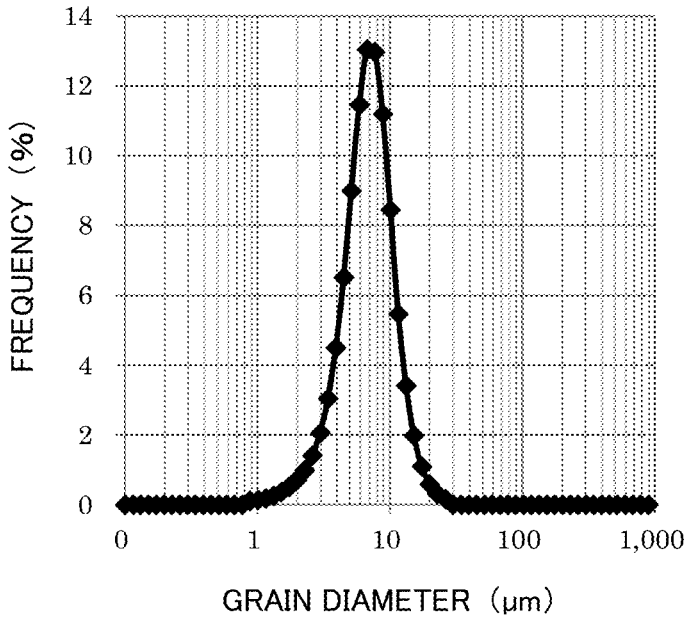
FIG. 7 is a grain size distribution diagram of atomized powder of Fe-based amorphous alloy employed in a metal powder core according to the present invention.

On the other hand, as the atomized powder of Fe-based soft magnetic alloy, Fe-based amorphous alloy atomized powder (composition formula: $Fe_{74}B_{11}Si_{11}C_2Cr_2$) (simply referred to as atomized powder) was prepared. This atomized powder is not crystallized unless heat treatment is performed at 510 degrees C. or lower. The grain size distribution and the average grain diameter were measured by using a laser diffraction scattering type particle diameter distribution measuring device (fabricated by Nikkiso Co., Ltd.; Microtrac). FIG. 7 is a grain size distribution diagram of the atomized powder. The measured average grain diameter (D50) of the atomized powder was 6 μm.

Figure 8:
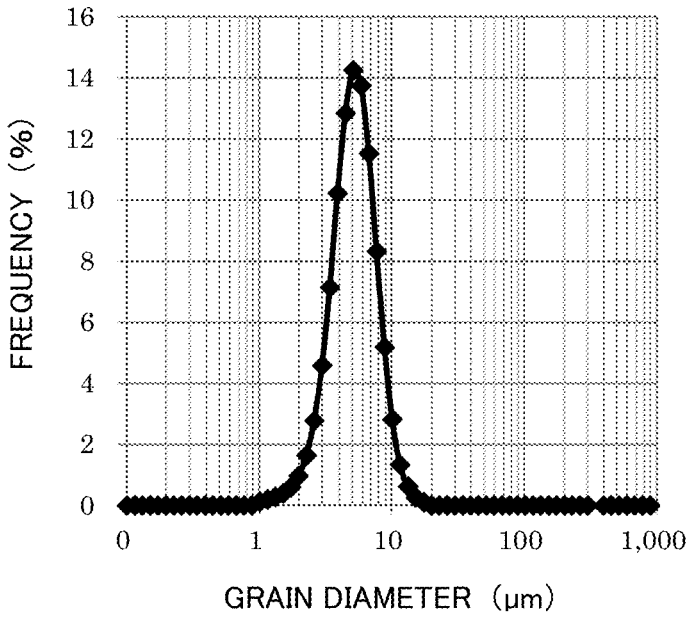
FIG. 8 is a grain size distribution diagram of Cu powder employed in a metal powder core according to the present invention.

Further, as the Cu powder, spherical atomized powder HXR-Cu fabricated by Nippon Atomized Metal Powders Corporation and having an average grain diameter (D50) of 5 μm was employed. FIG. 8 is a grain size distribution diagram of the Cu powder.

(First Process (Mixing of Soft Magnetic Material Powder and Cu Powder))

Figure 9:
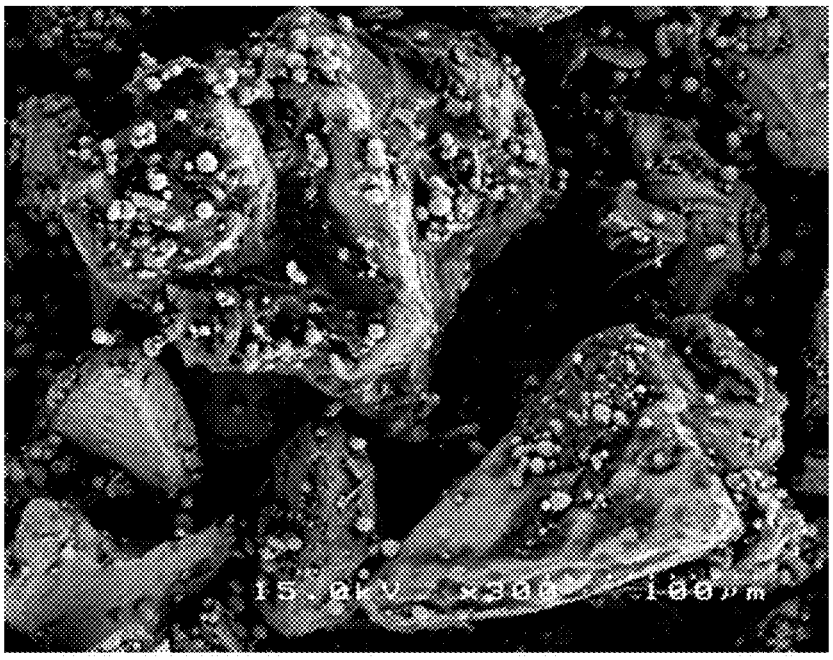
FIG. 9 is an SEM photograph presenting an external appearance of mixed powder (granulated powder) employed in a metal powder core according to the present invention.

Pulverized powder, atomized powder, and Cu powder as listed in Table 1 were weighed into mass ratios listed in Table 1 such that the total amount may become 100 mass %. Further, 0.66 mass % of phenylmethyl silicone (SILRES H44 fabricated by Wacker Asahikasei Silicone Co., Ltd.) serving as a high-temperature binder and 1.5 mass % of acrylic resin (Polysol AP-604 fabricated by Showa Highpolymer Co., Ltd.) serving as an organic binder were mixed into the total of 100 mass % of the pulverized powder, the atomized powder, and the Cu powder. Then, the obtained powder was dried at 120.C. for 10 hours so that mixed powder was obtained. FIG. 9 is an SEM photograph presenting an external appearance of the mixed powder. The mixed powder was in a state that the atomized powder, Cu powder, and the like are bound to the periphery of the pulverized powder by the organic binder.

Here, for the purpose of comparison, mixed powders (Nos. 1 to 7) were also prepared that were fabricated by adding no Cu powder and changing the added amount of the atomized powder.

(Second Process (Pressing) and Heat Treatment)

Each mixed powder obtained in the first process was passed through a sieve having an aperture of 425 μm so that granulated powder having a maximum diameter of approximately 600 μm or smaller was obtained. 0.4 mass % of zinc stearate was mixed into 100 mass % of this granulated powder and then pressure forming was performed at a pressure of 2.4 GPa at a room temperature (25 degrees C.) by using a pressing machine such that a toroidal shape having an outer diameter of 14 mm, an inner diameter of 8 mm, and a height of 6 mm may be obtained. Heat treatment (annealing) for 1 hour was performed on the obtained formed article in an oven in the air atmosphere at 420 degrees C. which is lower than the crystallization temperature Tx of the pulverized powder.

Figure 10:
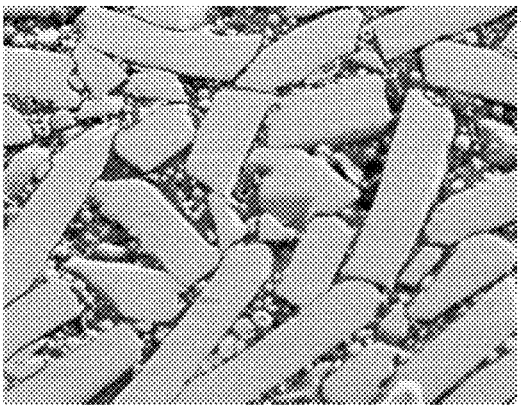
FIG. 10 is an SEM photograph of a cross section of a metal powder core according to the present invention.
Figure 11A:
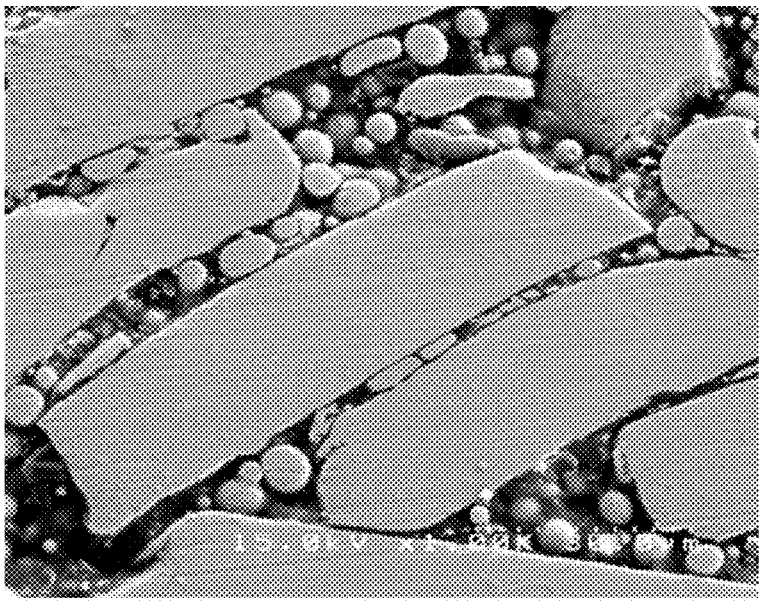
FIG. 11A is an SEM photograph of a cross section of a metal powder core according to the present invention.
Figure 11B:
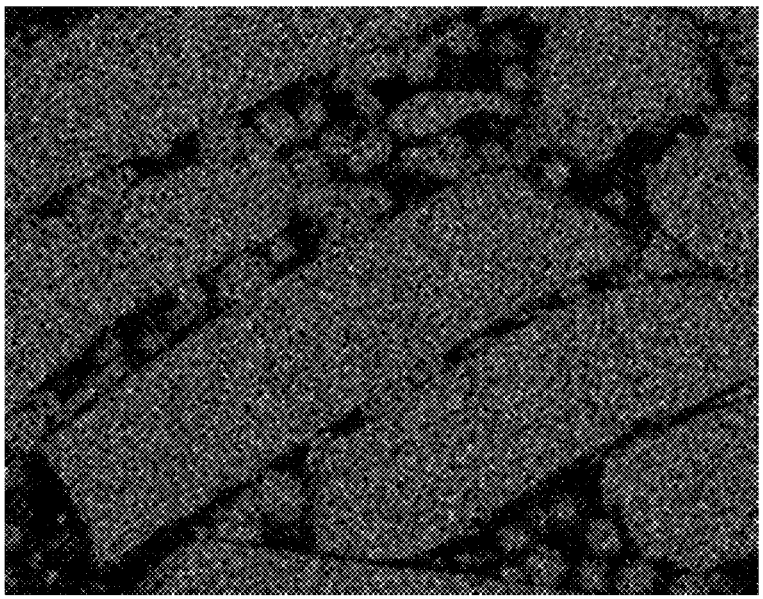
FIG. 11B is a mapping diagram presenting the distribution of Fe in a metal powder core according to the present invention.
Figure 11C:
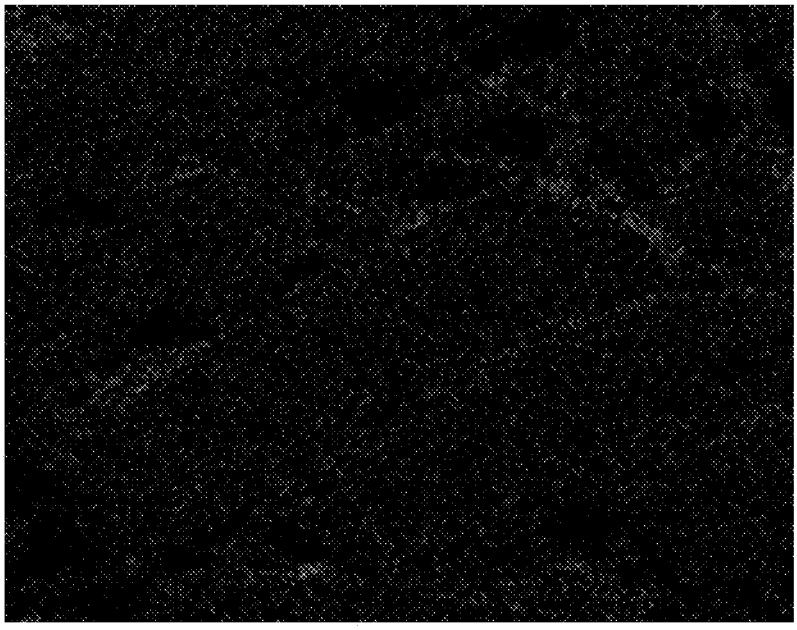
FIG. 11C is a mapping diagram presenting the distribution of Si in a metal powder core according to the present invention.
Figure 11D:
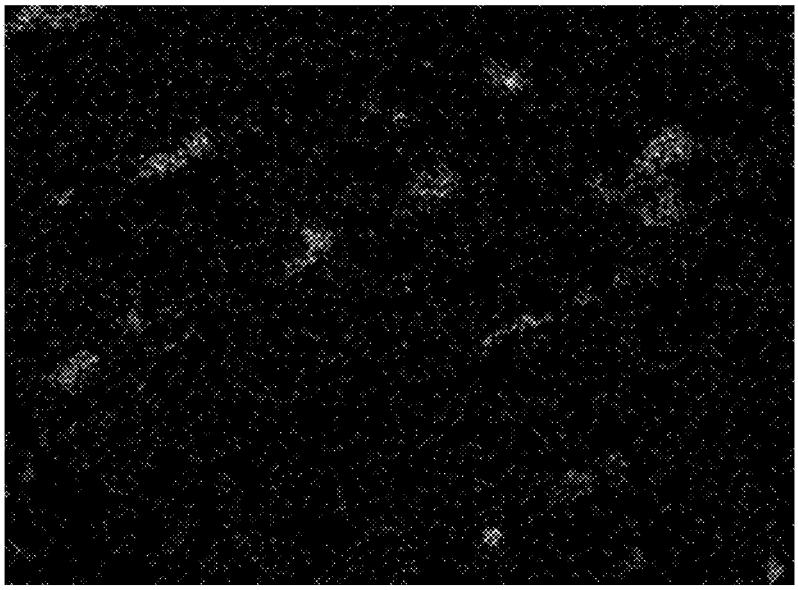
FIG. 11D is a mapping diagram presenting the distribution of Cu (Cu powder) in a metal powder core according to the present invention.

After the annealing, a cross section obtained by cutting the metal powder core in the forming compression direction was observed and the distribution of each powder was investigated by using a scanning electron microscope (SEM/EDX: Scanning Electron Microscope/Energy Dispersive X-ray spectroscopy). FIG. 10 illustrates an SEM photograph of a cross section of the metal powder core. Further, FIG. 11A is an SEM photograph of a cross section of the metal powder core and FIG. 11B is a mapping diagram presenting the distribution of Fe in a cross section of the metal powder core. FIG. 11C is a mapping diagram presenting the distribution of Si in a cross section of the metal powder core. FIG. 11D is a mapping diagram presenting the distribution of Cu (Cu powder) in a cross section of the metal powder core. In the SEM photographs, thickness cross sections of the pulverized powder have appeared and hence orientation has occurred. Further, it was recognized that the atomized powder and the Cu powder were dispersed among the pulverized powder in the view field of observation.

(Measurement of Magnetic Property and the Like)

In the toroid-shaped metal powder core fabricated by the above-described process, winding of 29 turns was provided on each of the primary and the secondary windings by using an insulation-coated lead wire having a diameter of 0.25 mm. The core loss Pcv was measured on conditions consisting of a maximum magnetic flux density of 50 mT, a frequency of 50 kHz, a maximum magnetic flux density of 150 mT, and a frequency of 20 kHz by using a B—H Analyzer SY-8232 fabricated by Iwatsu Test Instruments Corporation. Further, the initial permeability μi was measured for the metal powder core provided with 30 turns of winding with a condition of a frequency of 100 kHz by using HP4284A fabricated by Hewlett-Packard Company. The incremental permeability μΔ was measured on conditions consisting of an applied direct-current magnetic field of 10 kA/m and a frequency of 100 kHz.

Further, a load was applied in the radial direction of the toroid-shaped metal powder core so that the maximum load P (N) at the time of core breakage was measured. Then, the radial crushing strength σr (MPa) was calculated from the following formula $$\sigma r = P(D-d)/(Id^2)$$

(Here, D: the outer diameter (mm) of the core, d: the thickness (mm) of the core, and I: the height (mm) of the core.) These results are listed in Table 1. Here, the sample whose No. is provided with * in the table indicates a comparison example.

TABLE 1

| No | CONTENT OF Fe GROUP ATOMIZED POWDER (MASS %) | CONTENT OF Cu POWDER (MASS %) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|
| *1 | 0.0 | 0.0 | — | 6.5 | — | 32.6 | — | 157 |
| *2 | 1 | 0.0 | 5.6 | 6.3 | 50.4 | 33.3 | 37 | 141 |
| *3 | 2.9 | 0.0 | 5.6 | 6.8 | 49.5 | 33.0 | 33 | 141 |
| *4 | 4.8 | 0.0 | 5.6 | 7.1 | 53.9 | 33.6 | 33 | 148 |
| *5 | 9.1 | 0.0 | 5.7 | 7.2 | 56.3 | 33.8 | 29 | 133 |
| *6 | 13.0 | 0.0 | 5.8 | 8.3 | 56.6 | 33.8 | 28 | 130 |
| *7 | 16.7 | 0.0 | 5.7 | 8.1 | 55.1 | 33.4 | 26 | 129 |
| 8 | 4.75 | 0.30 | 5.7 | 7.7 | 52.7 | 33.5 | 31 | 141 |
| 9 | 4.73 | 0.60 | 5.6 | 8.4 | 51.3 | 33.2 | 36 | 140 |
| 10 | 4.71 | 1.1 | 5.6 | 9.8 | 51.5 | 33.3 | 30 | 132 |
| 11 | 4.68 | 1.4 | 5.6 | 9.8 | 49.6 | 33.1 | 30 | 127 |

—: NOT-EVALUATED

As listed in Table 1, in the metal powder cores of comparison example Nos. 1 to 7 in which Cu powder was not contained, there was a tendency that with increasing added amount of the atomized powder, the radial crushing strength and the incremental permeability increase. Further, there was a tendency that with increasing added amount of the atomized powder the core loss Pcv decreases. However, there also was a tendency that with increasing added amount of the atomized powder, the radial crushing strength and the incremental permeability are saturated or reduced. This indicates the presence of a limitation in improvement of the radial crushing strength and the like.

The metal powder cores of Nos. 8 to 11 were metal powder cores fabricated by employing an added amount of 5 mass % of Fe group atomized powder and by changing the content of Cu powder. As listed in Table 1, with increasing content of Cu powder, the radial crushing strength has increased. That is, it has been recognized that when Cu powder is dispersed among the soft magnetic material powder, a radial crushing strength at a yet higher level is obtained than in the case (No. 4) that Fe group atomized powder is added. In particular, when the content of Cu powder was 1.1 mass % or higher, an effect of remarkable improvement in the radial crushing strength was obtained.

Further, as clearly seen from the results in Table 1, with increasing content of Cu powder, the core loss was also improved. Despite that Cu powder is a conductor and hence the effect of insulation is not expected, the core loss is remarkably reduced. This is a characteristic point. It is recognized that a Cu powder content of 1.1 mass % or higher provides an especially large reduction effect. Further, when the content of Cu powder is 0.3 to 1.4 mass %, in a state that the effects of core loss reduction and strength enhancement are improved, the reduction in the incremental permeability is suppressed within 1.5% in comparison with a case that Cu is not contained. That is, the incremental permeability μΔ does not largely vary in spite of an increase in the Cu content. Thus, it has been recognized that the configuration that Cu powder is added and dispersed is especially effective in improvement of the radial crushing strength and reduction of the core loss in a state that degradation of the magnetic property is suppressed.

Embodiment 2

The same pulverized powder of Fe-based amorphous alloy as that in the Embodiment given above was employed and, further, atomized powder having the same composition and different grain size distribution (D50 is 6.4 μm or 12.3 μm) was employed. As Cu powder, spherical atomized powder HXR-Cu (D50 is 4.8 μm in Table 2) or SFR-Cu (D50 is 7.7 μm in Table 2) fabricated by Nippon Atomized Metal Powders Corporation was employed. Then, 1 mass % of phenylmethyl silicone (SILRES H44 fabricated by Wacker Asahikasei Silicone Co., Ltd.) was employed as a high-temperature binder and the heat treatment temperature was set to be 425 degrees C. The other conditions were the same as those in Embodiment e 1. Metal powder cores were fabricated as such. The magnetic property and the strength of the obtained samples are listed in Table 2.

TABLE 2

| No | CONTENT OF Fe GROUP ATOMIZED POWDER (MASS %) | AVERAGE DIAMETER OF Fe GROUP ATOMIZED POWDER (μm) | CONTENT OF Cu POWDER (MASS %) | AVERAGE DIAMETER OF Cu POWDER D50 (μm) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|---|
| 12 | 10 | 6.4 | 1.5 | 7.7 | 5.6 | 14.5 | 52.2 | 31.9 | 32 | 156 |
| 13 | 10 | 12.3 | 1.5 | 4.8 | 5.6 | 15.8 | 50.9 | 31.7 | 31 | 154 |
| 14 | 10 | 12.3 | 1.5 | 7.7 | 5.6 | 13.9 | 51.3 | 31.6 | 35 | 166 |

In the obtained metal powder cores, as a result of the increase in the amount of high-temperature binder, the radial crushing strength was improved, the initial permeability and the incremental permeability were decreased, and the core loss was increased in comparison with Embodiment 1.

Within the range listed in Table 2, no large difference in the strength and the magnetic property was found among the samples.

Embodiment 3 and Comparison Example 2

As Embodiment 3, the same pulverized powder of Fe-based amorphous alloy as that in Embodiment 1 was employed and, further, atomized powder whose composition was the same as that in Embodiment 1 and whose D50 was 6.4 μm was employed. Further, as nonmagnetic material powder, atomized powder of CuSn alloy SF-Br9010 (Cu 90 mass %, Sn 10 mass %, D50: 4.7 μm), SF-Br8020 (Cu 80 mass %, Sn 20 mass %, D50: 5.0 μm), or SF-Br7030 (Cu 70 mass %, Sn 30 mass %, D50: 5.2 μm) fabricated by Nippon Atomized Metal Powders Corporation was employed. Then, 1 mass % of phenylmethyl silicone (SILRES H44 fabricated by Wacker Asahikasei Silicone Co., Ltd.) serving as a high-temperature binder was added and the heat treatment temperature was set to be 425 degrees C. The other conditions were the same as those in Embodiment 1.

Further, as Comparison Example 2, the same pulverized powder of Fe-based amorphous alloy was employed and, further, atomized powder was not contained. Further, as nonmagnetic material powder, Sn powder (SFR-Sn fabricated by Nippon Atomized Metal Powders Corporation), Ag powder (HXR-Ag fabricated by Nippon Atomized Metal Powders Corporation), or Ag powder (#600F fabricated by Minalco Ltd.) was employed. Metal powder cores were fabricated as such. In sample No. 20, 1.4 mass % of phenylmethyl silicone (SILRES H44 fabricated by Wacker Asahikasei Silicone Co., Ltd.) was employed as a high-temperature binder and 2.0 mass % of acrylic resin (Polysol AP-604 fabricated by Showa Highpolymer Co., Ltd.) was employed as an organic binder. In the other samples, the employed conditions were the same as those in Embodiment 3.

Table 3 lists the strength and the magnetic property of the samples obtained in Embodiment 3 and Comparison Example 2.

TABLE 3

| No | CONTENT OF Fe GROUP ATOMIZED POWDER (MASS %) | NONMAGNETIC MATERIAL POWDER | AVERAGE DIAMETER OF NONMAGNETIC MATERIAL POWDER D50 (μm) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|
| 15 | 10 | Cu-10% Sn | 4.7 | 5.6 | 15.2 | 52.8 | 32.0 | 51 | 184 |
| 16 | 10 | Cu-20% Sn | 5.0 | 5.6 | 14.8 | 52.6 | 32.0 | 51 | 184 |
| 17 | 10 | Cu-30% Sn | 5.2 | 5.6 | 13.2 | 52.1 | 31.7 | 53 | 194 |
| *18 | 0 | Sn | 5.4 | 5.5 | 11.5 | 42.0 | 30.0 | 51 | 184 |
| *19 | 0 | Ag | 5.3 | 5.5 | 13.9 | 42.0 | 30.1 | 53 | 188 |
| *20 | 0 | Al | 5.0 | 5.3 | 13.2 | 43.2 | 28.4 | 65 | 251 |

Even when Cu alloy was employed as the nonmagnetic material powder, an excellent radial crushing strength and an excellent magnetic property were obtained.

Embodiment 4 and Comparison Example 3

As Embodiment 4 and Comparison Example 3, the same pulverized powder of Fe-based amorphous alloy as that in Embodiment 1 was employed and, further, atomized powder whose composition was the same as that in Embodiment 1 and whose D50 was 6.4 μm was employed. As Cu powder, spherical atomized powder HXR-Cu (D50: 4.8 μm) fabricated by Nippon Atomized Metal Powders Corporation was employed. Then, 1 mass % of phenylmethyl silicone (SILRES H44 fabricated by Wacker Asahikasei Silicone Co., Ltd.) serving as a high-temperature binder was added and the heat treatment temperature was set to be 360 degrees C. to 455 degrees C. The other conditions were the same as those in Embodiment 1.

TABLE 4

| No | HEAT TREATMENT TEMPERATURE (° C.) | CONTENT OF Fe GROUP ATOMIZED POWDER (MASS %) | AVERAGE DIAMETER OF Fe GROUP ATOMIZED POWDER D50 (μm) | CONTENT OF Cu POWDER (MASS %) | AVERAGE DIAMETER OF Cu POWDER D50 (μm) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|---|---|
| *21 | 360 | 10 | 6.4 | 1.5 | 4.7 | 5.7 | 14.1 | 37.6 | 24.1 | 369 | 1465 |
| *22 | 380 | 10 | 6.4 | 1.5 | 4.7 | 5.7 | 14.8 | 45.8 | 28.4 | 215 | 789 |
| *23 | 405 | 10 | 6.4 | 1.5 | 4.7 | 5.6 | 14.3 | 49.2 | 30.8 | 88 | 320 |

TABLE 4-continued

| No | HEAT TREATMENT TEMPERA-TURE (° C.) | CONTENT OF Fe GROUP ATOMIZED POWDER (MASS %) | AVERAGE DIAMETER OF Fe GROUP ATOMIZED POWDER D50 (μm) | CONTENT OF Cu POWDER (MASS %) | AVERAGE DIAMETER OF Cu POWDER D50 (μm) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|---|---|
| 24 | 415 | 10 | 6.4 | 1.5 | 4.7 | 5.6 | 14.0 | 50.6 | 31.2 | 61 | 225 |
| 25 | 425 | 10 | 6.4 | 1.5 | 4.7 | 5.6 | 14.7 | 49.8 | 31.7 | 53 | 188 |
| 26 | 435 | 10 | 6.4 | 1.5 | 4.7 | 5.6 | 15.3 | 48.3 | 32.1 | 52 | 202 |
| 27 | 445 | 10 | 6.4 | 1.5 | 4.7 | 5.6 | 15.5 | 44.4 | 32.1 | 56 | 289 |
| *28 | 455 | 10 | 6.4 | 1.5 | 4.7 | 5.7 | 18.4 | 41.9 | 31.7 | 68 | 603 |

Figure 12:
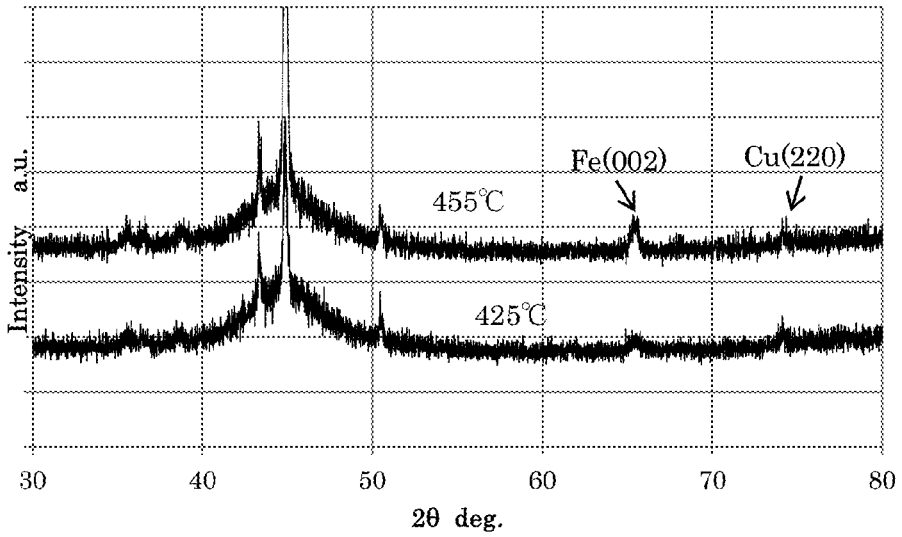
FIG. 12 is an X-ray diffraction pattern diagram of metal powder cores whose heat treatment temperatures are 425 degrees C. and 455 degrees C.

As a result of X-ray diffraction measurement employing Cu—Kα line, the α-Fe crystal was recognized in the diffraction pattern when the heat treatment temperature was 410 degrees C. or higher. FIG. 12 illustrates the results of X-ray diffraction measurement of the metal powder cores whose heat treatment temperature was 425 degrees C. or 455 degrees C. In the X-ray diffraction measurement employing Cu—Kα line, the ratio $I_{002}/I_{220}$ of the peak intensity $I_{002}$ of Fe (002) plane to the peak intensity $I_{220}$ of Cu (220) plane was 0.76 in the case of a heat treatment temperature of 425 degrees C. and 1.02 in the case of 455 degrees C.

The radial crushing strength has increased with increasing heat treatment temperature. However, after a peak obtained at a heat treatment temperature of 415 degrees C., the initial permeability μi has decreased with increasing heat treatment temperature. Further, the core loss has increased after a bottom obtained at a heat treatment temperature of 425 degrees C.

Embodiment 5 and Comparison Example 4

The mixing ratios of pulverized powder of Fe-based amorphous alloy, atomized powder, and Cu powder were changed. The same pulverized powder of Fe-based soft magnetic alloy was employed and, further, atomized powder whose composition was the same as that in Embodiment 1 and whose D50 was 6.4 μm was employed. Further, as Cu powder, spherical atomized powder HXR-Cu (D50 is 4.8 μm in Table 2) fabricated by Nippon Atomized Metal Powders Corporation was employed.

Then, 1 mass % of phenylmethyl silicone (SILRES H44 fabricated by Wacker Asahikasei Silicone Co., Ltd.) was employed as a high-temperature binder and the heat treatment temperature was set to be 425 degrees C. The other conditions were the same as those in Embodiment 1 except for No. 40. In No. 40, the mold tool and the mixed powder prior to forming were warmed to 130 degrees C. and then forming was performed.

TABLE 5

| No | CONTENT OF Fe GROUP ATOMIZED POWDER (MASS %) | CONTENT OF Cu POWDER (MASS %) | FORMING TEMPERA-TURE (° C.) | PRESSURE (GPa) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|---|
| *29 | 0 | 0 | 25 | 2.4 | 5.6 | 13.8 | 47.9 | 32.2 | 49 | 203 |
| *30 | 0 | 0.5 | 25 | 2.4 | 5.5 | 13.4 | 47.5 | 31.6 | 46 | 171 |
| *31 | 0 | 1 | 25 | 2.4 | 5.6 | 14.5 | 47.5 | 31.8 | 46 | 161 |
| *32 | 0 | 1.5 | 25 | 2.4 | 5.6 | 14.6 | 46.3 | 31.4 | 43 | 149 |
| *33 | 0 | 3 | 25 | 2.4 | 5.6 | 19.2 | 45.7 | 31.5 | 40 | 149 |
| *34 | 0 | 5 | 25 | 2.4 | 5.7 | 22.0 | 44.6 | 30.9 | 37 | 150 |
| *35 | 5 | 0 | 25 | 2.4 | 5.6 | 14.8 | 51.7 | 33.3 | 42 | 173 |
| 36 | 5 | 0.5 | 25 | 2.4 | 5.6 | 14.1 | 50.7 | 32.8 | 38 | 161 |
| 37 | 5 | 1 | 25 | 2.4 | 5.7 | 14.7 | 50.8 | 33.0 | 41 | 159 |
| 38 | 5 | 1.5 | 25 | 2.0 | 5.5 | 15.5 | 48.2 | 31.9 | 46 | 149 |
| 39 | 5 | 1.5 | 25 | 2.4 | 5.6 | 16.1 | 51.3 | 32.7 | 39 | 144 |
| 40 | 5 | 1.5 | 130 | 2.0 | 5.9 | 23.5 | 58.9 | 34.5 | 35 | 153 |
| 41 | 5 | 3 | 25 | 2.4 | 5.7 | 19.3 | 48.6 | 32.7 | 35 | 142 |
| 42 | 5 | 5 | 25 | 2.4 | 5.7 | 23.6 | 46.4 | 31.9 | 37 | 133 |
| *43 | 10 | 0 | 25 | 2.4 | 5.7 | 14.3 | 52.1 | 33.5 | 43 | 170 |
| 44 | 10 | 0.5 | 25 | 2.4 | 5.7 | 14.4 | 54.1 | 33.9 | 34 | 149 |
| 45 | 10 | 1 | 25 | 2.4 | 5.7 | 14.7 | 52.1 | 33.7 | 37 | 150 |
| 46 | 10 | 1.5 | 25 | 2.4 | 5.7 | 15.7 | 51.5 | 33.4 | 34 | 140 |
| 47 | 10 | 3 | 25 | 2.4 | 5.8 | 18.5 | 49.5 | 33.1 | 31 | 123 |
| 48 | 10 | 5 | 25 | 2.4 | 5.7 | 22.4 | 45.5 | 31.5 | 34 | 124 |

TABLE 6

| No | CONTENT OF Fe GROUP ATOMIZED POWDER (MASS %) | CONTENT OF Cu POWDER (MASS %) | FORMING TEMPERATURE (° C.) | PRESSURE (GPa) | DENSITY ds ($\times 10^3$ kg/m$^3$) | RADIAL CRUSHING STRENGTH (MPa) | μ i | μ Δ | Pcv (kW/m$^3$) 50 mT 50 kHz | Pcv (kW/m$^3$) 150 mT 20 kHz |
|---|---|---|---|---|---|---|---|---|---|---|
| *49 | 15 | 0 | 25 | 2.4 | 5.7 | 14.3 | 54.2 | 33.6 | 43 | 164 |
| 50 | 15 | 0.5 | 25 | 2.4 | 5.8 | 14.7 | 53.3 | 33.4 | 35 | 153 |
| 51 | 15 | 1 | 25 | 2.4 | 5.7 | 14.4 | 51.8 | 33.2 | 38 | 148 |
| 52 | 15 | 1.5 | 25 | 2.4 | 5.7 | 15.0 | 50.4 | 32.8 | 38 | 153 |
| 53 | 15 | 3 | 25 | 2.4 | 5.7 | 19.0 | 48.8 | 32.4 | 34 | 133 |
| *54 | 20 | 0 | 25 | 2.4 | 5.8 | 13.7 | 52.6 | 32.3 | 34 | 149 |
| 55 | 20 | 1.5 | 25 | 2.4 | 5.8 | 14.7 | 50 | 31 | 35 | 155 |
| *56 | 2.5 | 0 | 25 | 2.4 | 5.6 | — | 49.4 | 31.8 | 43 | 188 |
| 57 | 2.5 | 1 | 25 | 2.4 | 5.6 | — | 48.9 | 31.7 | 39 | 158 |
| 58 | 2.5 | 2 | 25 | 2.4 | 5.6 | — | 48.7 | 31.5 | 39 | 149 |
| 59 | 2.5 | 3 | 25 | 2.4 | 5.7 | — | 48.4 | 31.7 | 32 | 129 |
| *60 | 0 | 2 | 25 | 2.4 | 5.6 | — | 46.7 | 31.2 | 35 | 131 |
| 61 | 5 | 2 | 25 | 2.4 | 5.7 | — | 50.3 | 32.2 | 30 | 141 |
| 62 | 10 | 2 | 25 | 2.4 | 5.7 | — | 50.7 | 31.8 | 32 | 133 |
| 63 | 15 | 2 | 25 | 2.4 | 5.8 | — | 49.6 | 31.2 | 34 | 135 |

—: NOT-EVALUATED

With increasing ratio of the Cu powder, the radial crushing strength has increased and the core loss has decreased. However, the initial permeability has decreased. With increasing ratio of the atomized powder of Fe-based soft magnetic alloy, the initial permeability has increased. However, the radial crushing strength has decreased and the core loss has increased. Such a tendency was observed.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. A metal powder core, the metal powder core comprising:

soft magnetic material powder of Fe-based soft magnetic alloy; and

Cu powder;

wherein:

the soft magnetic material powder includes thin-plate shaped pulverized powder and atomized powder, the Cu powder and the atomized powder are dispersed among the thin-plate shaped pulverized powder, the Cu powder and the atomized powder are bound to a surface of the thin-plate shaped pulverized powder by a binder, and when the total amount of the soft magnetic material powder and the Cu powder is referred to as 100 mass %, the content of atomized powder of Fe-based soft magnetic alloy is 1 mass % or higher and 20 mass % or lower, the content of Cu powder is 0.1 mass % or higher and 5 mass % or lower, and the remaining part is pulverized powder of Fe-based soft magnetic alloy.

2. The metal powder core according to claim 1, wherein the pulverized powder and the atomized powder have an amorphous structure.

3. The metal powder core according to claim 2, wherein the pulverized powder has an α-Fe crystalline phase in a part of the amorphous structure.

4. The metal powder core according to claim 1, wherein an insulation coating of silicon oxide is provided at least on a surface of a particle of the pulverized powder of Fe-based soft magnetic alloy.

5. A coil component, comprising:

the metal powder core according to claim 1; and a coil wound around the metal powder core.

6. The metal powder core according to claim 1, wherein the Cu powder is granular and has an average grain diameter of 2 μm or more and of 8 μm or less, the average grain diameter being smaller than or equal to a thickness of the pulverized powder of Fe-based soft magnetic alloy.

* * * * *